US006619765B2

(12) United States Patent
Visser et al.

(10) Patent No.: US 6,619,765 B2
(45) Date of Patent: Sep. 16, 2003

(54) OFFICE DESK WITH COMPUTER WORKSTATION

(76) Inventors: Casper Petrus Visser, P.O. Box 3452, Glenvista 2058 (ZA); Ronald William Marnefeldt, P.O. Box 3452, Glenvista 2058 (ZA)

( * ) Notice: Subject to any disclaimer, the term of this patent is extended or adjusted under 35 U.S.C. 154(b) by 90 days.

(21) Appl. No.: 09/935,482

(22) Filed: Aug. 22, 2001

(65) Prior Publication Data

US 2002/0053862 A1 May 9, 2002

(30) Foreign Application Priority Data

Aug. 22, 2000 (ZA) ..... 2000/4306

(51) Int. Cl.[7] ..... A47B 5/00
(52) U.S. Cl. ..... 312/194; 312/223.3
(58) Field of Search ..... 312/194, 208.1, 312/223.3, 7.2; 108/50.02, 50.01; 248/917, 918, 923, 919, 920, 922, 921

(56) References Cited

U.S. PATENT DOCUMENTS 4,755,009 A 7/1988 Price et al.
5,071,204 A * 12/1991 Price et al. ..... 312/194
5,199,773 A * 4/1993 Price et al. ..... 312/7.2
5,377,951 A * 1/1995 Johnson et al. ..... 248/639
5,410,972 A 5/1995 Schairbaum
5,655,822 A * 8/1997 Roberts et al. ..... 312/194
5,694,861 A * 12/1997 Laukamm-Josten ..... 108/50.01
6,012,694 A * 1/2000 Sullivan, III ..... 248/323
D456,170 S * 4/2002 Chang ..... D6/425
D473,067 S * 4/2003 Chang ..... D6/425

FOREIGN PATENT DOCUMENTS

DE 1 957318 * 5/1971 ..... 312/208.1

* cited by examiner

*Primary Examiner*—Janet M. Wilkens
(74) *Attorney, Agent, or Firm*—Knobbe, Martens, Olson & Bear, LLP

(57) ABSTRACT

A support for a computer monitor and/or central processing unit (CPU) and/or computer keyboard in furniture in which the monitor will be visible through a transparent panel in a working surface, in which the support includes a single beam which can be attached to and detached from legs of a table, extending transversely between the legs when attached. Suspending links can be attached to and detached from the beam to support platforms for the monitor and/or the CPU. The keyboard is connected by links to the platform for the monitor so that when the keyboard support is pulled out for use the monitor is moved into an operative position from an inoperative position in which it is out of the way.

9 Claims, 11 Drawing Sheets

OFFICE DESK WITH COMPUTER WORKSTATION

BACKGROUND OF THE INVENTION

1. Field of the Invention

This invention lies in the field of support means for a computer monitor and/or central processing unit arid/or computer keyboard in furniture in which the monitor will be visible through a transparent panel in a working surface.

2. Description of the Related Art

U.S. Pat. No. 4,755,009 to Price discloses a flat top desk housing components of a computer work station with the computer monitor thereof mounted on a trolley which can be wheeled to a position under a transparent panel in the desk top, to be viewed through this panel when working on the computer.

Price '009 discloses adjustment of the monitor for a particular operator by rolling the trolley out to allow adjusting the height and angle of the monitor and rolling the trolley back to any desired horizontal position under the transparent panel of the desk top. Disadvantages of the arrangement are the very fact that it must be rolled out for adjustment and that upon return it will not be constrained automatically to return to the desired or optimum position. It is not disclosed, nor is it apparent, whether the monitor can be moved deeper into the space under the desk when not in use, in order to be out of the way, but if it is, the disadvantages mentioned will also apply.

U.S. Pat. No. 5,410,972 to Schairbaum discloses a desk-like structure, which has a transparent portion in the desk top and various embodiments of an adjustable suspending assembly for supporting a computer monitor under the transparent surface to be viewed when working on the computer. The monitor is suspended by various means all of which are screwed into the underneath surface of the desk top with some fore and aft and transverse adjustment provided for. It is not easy or convenient to screw into the underneath surface of a desk top and screws may pull out, especially with the tendency to use thinly veneered wood chip material these days.

Both of these disclosures teach the provision of a keyboard which is pulled out from a storage position under the front region of the desk top when not in use to a position extended in front of the desk top when in use. A disadvantage of these disclosures is that the keyboard must be moved independently of the monitor.

SUMMARY OF THE INVENTION

It is an object of the present invention to provide an adjustable suspended support means of a monitor from a beam extending between legs of a desk-like structure having a transparent portion for viewing the monitor and conveniently connectable to and disconnectable therefrom.

It is a further object to provide for the connection of the keyboard to the monitor support so that, when the keyboard is pulled out from an inoperative position to an operative position, the monitor is simultaneously moved from an inoperative position to an operative position. Hence the monitor may be located in a less obstructive position to the legs of a person seated at the desk-like structure when the computer is not in use.

It is a further object of the invention that the monitor is constrained so that it is moved to the same selected position every time it is to be used.

A further object of the invention is to provide an adjustable suspended support for a Central Processing Unit (CPU) of a computer work station from a beam extending between legs of a desk-like structure and conveniently connectable to and disconnectable therefrom.

Further objects and advantages of the invention will become apparent from the appended description of the invention by way of an example with reference to the drawings.

BRIEF DESCRIPTION DRAWINGS

In the drawings: FIG. 1 is a front elevation view of a desk-like structure;

DESCRIPTION OF THE PREFERRED EMBODIMENTS

Figure 1:
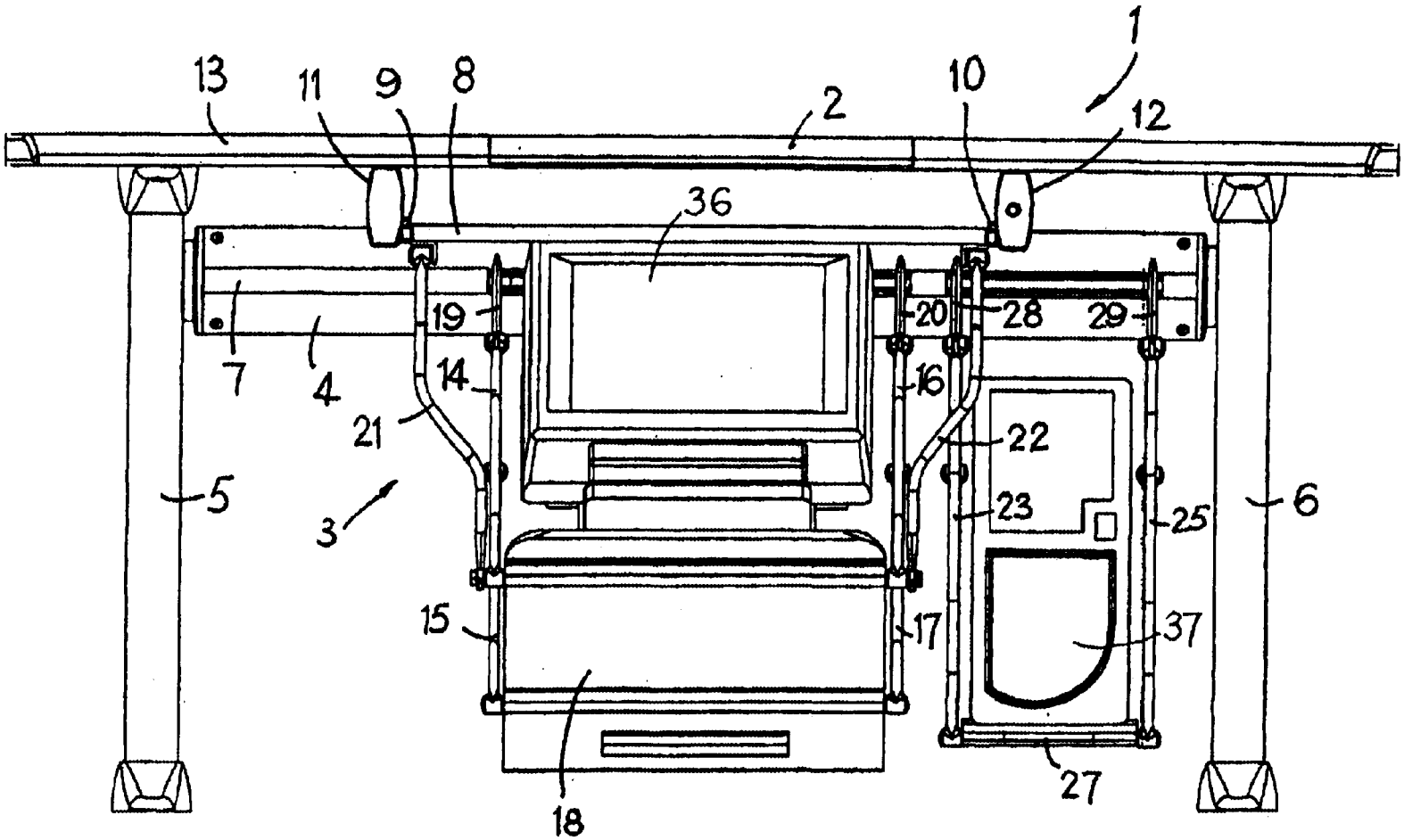
Figure 2:
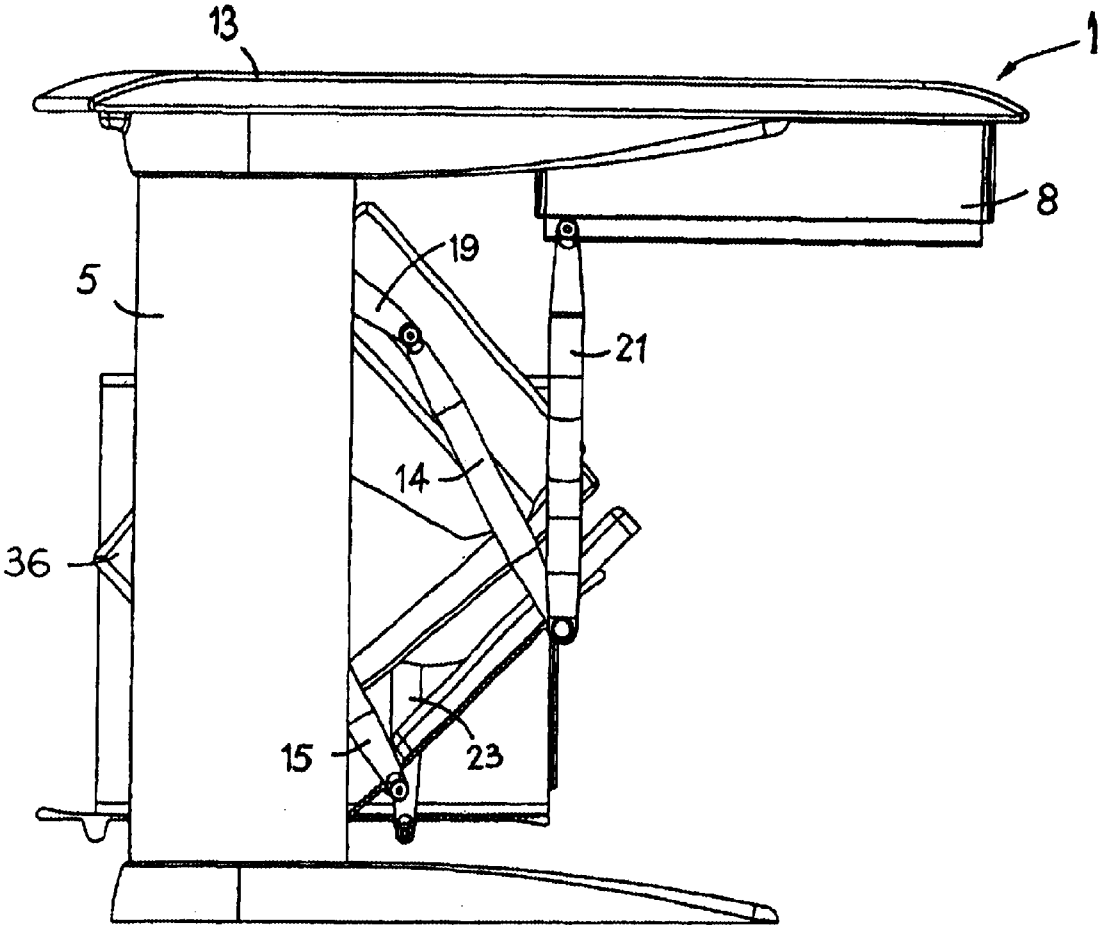
FIG. 2 is a side view thereof.
Figure 3:
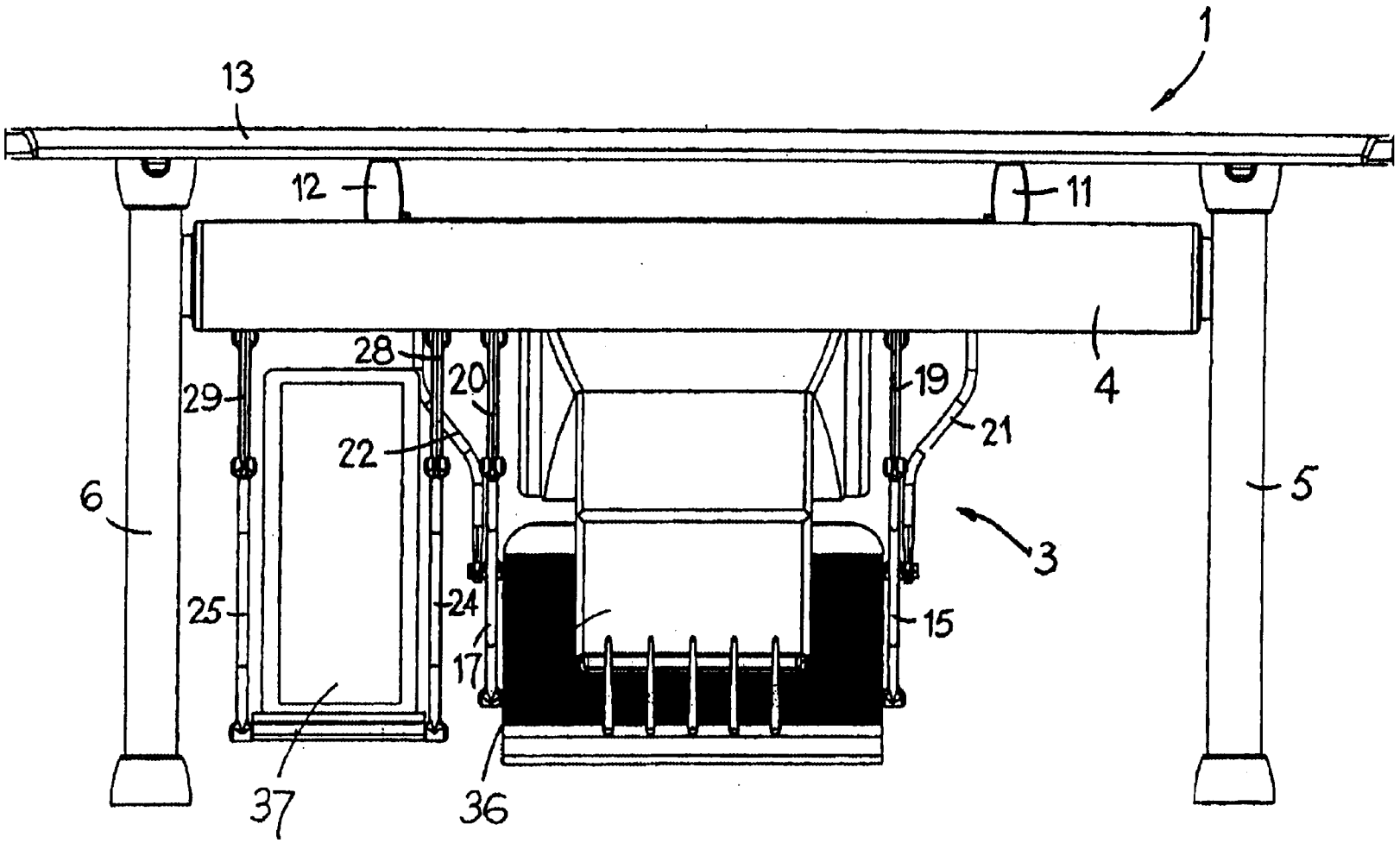
FIG. 3 is a rear elevation view thereof.
Figure 4:
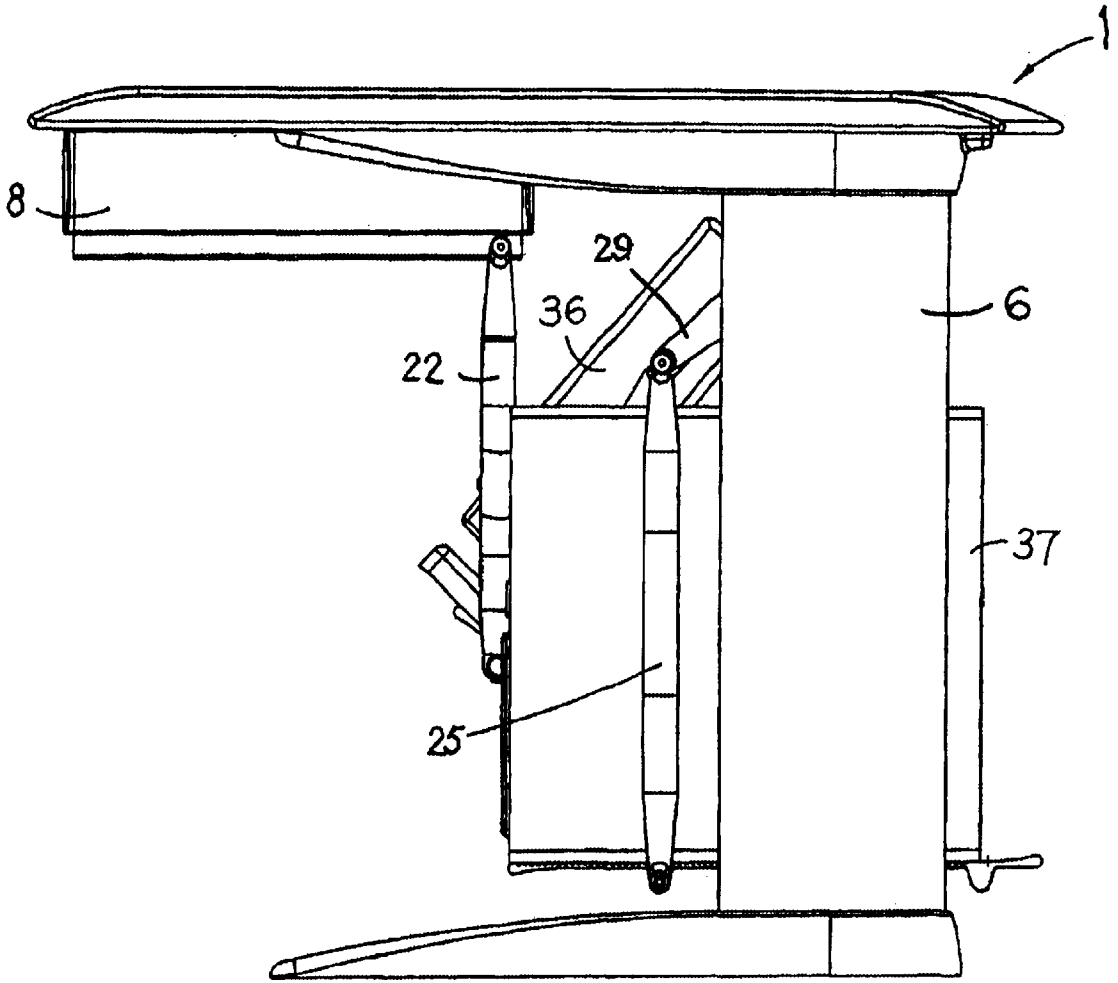
FIG. 4 is a right-hand view thereof.
Figure 5:
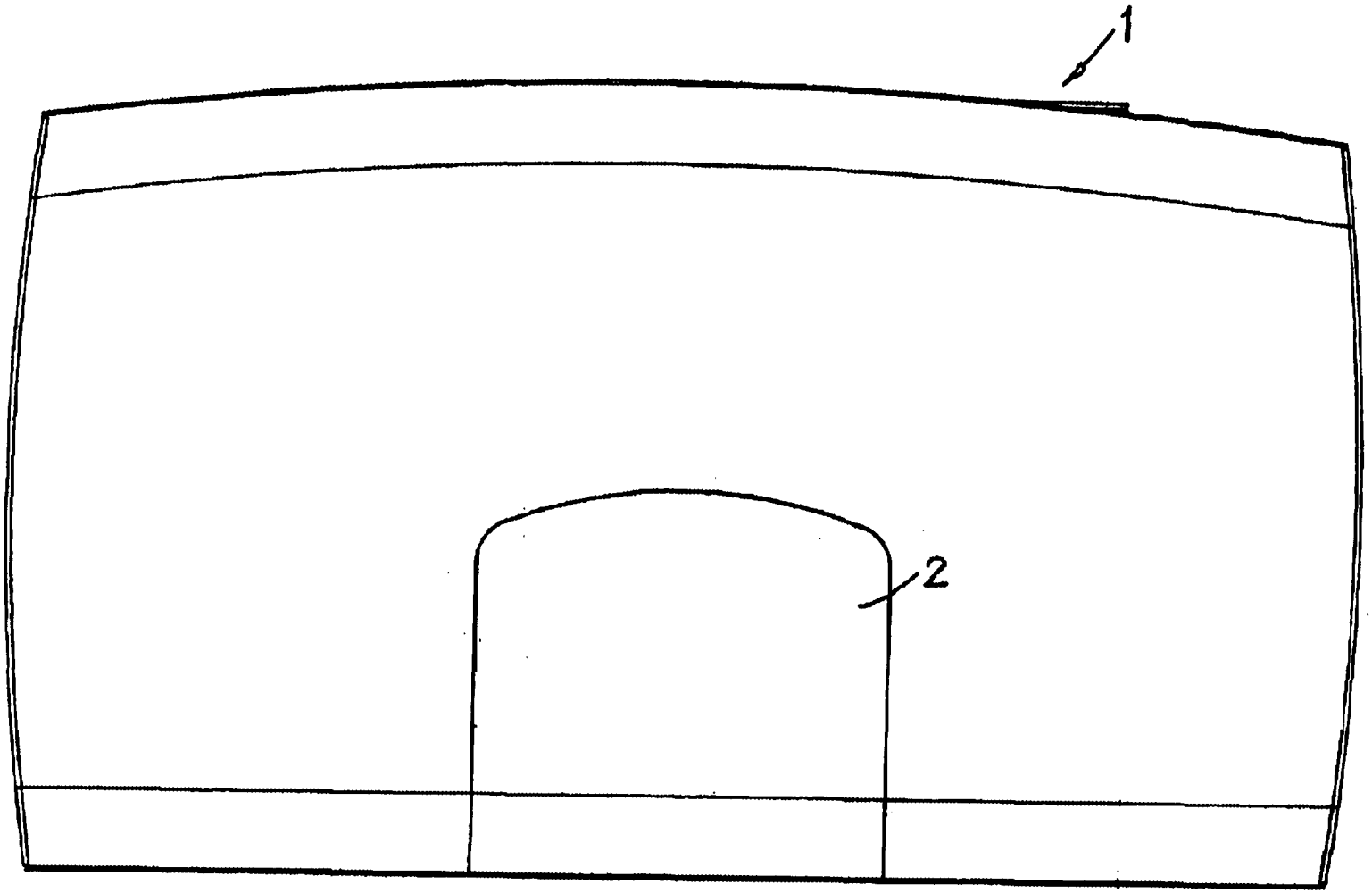
FIG. 5 is a plan view thereof.
Figure 6:
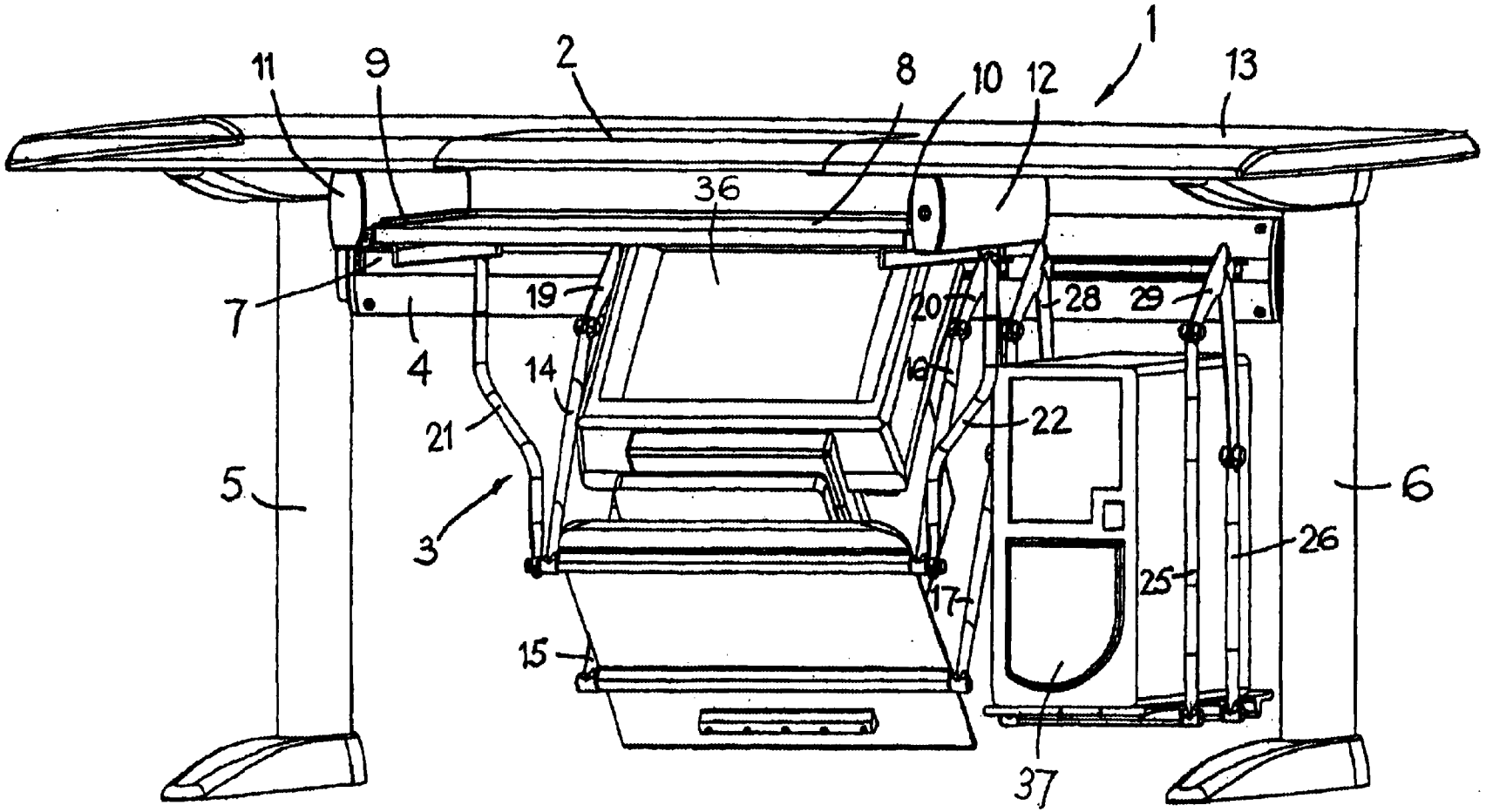
FIG. 6 is an oblique front view thereof.
Figure 7:
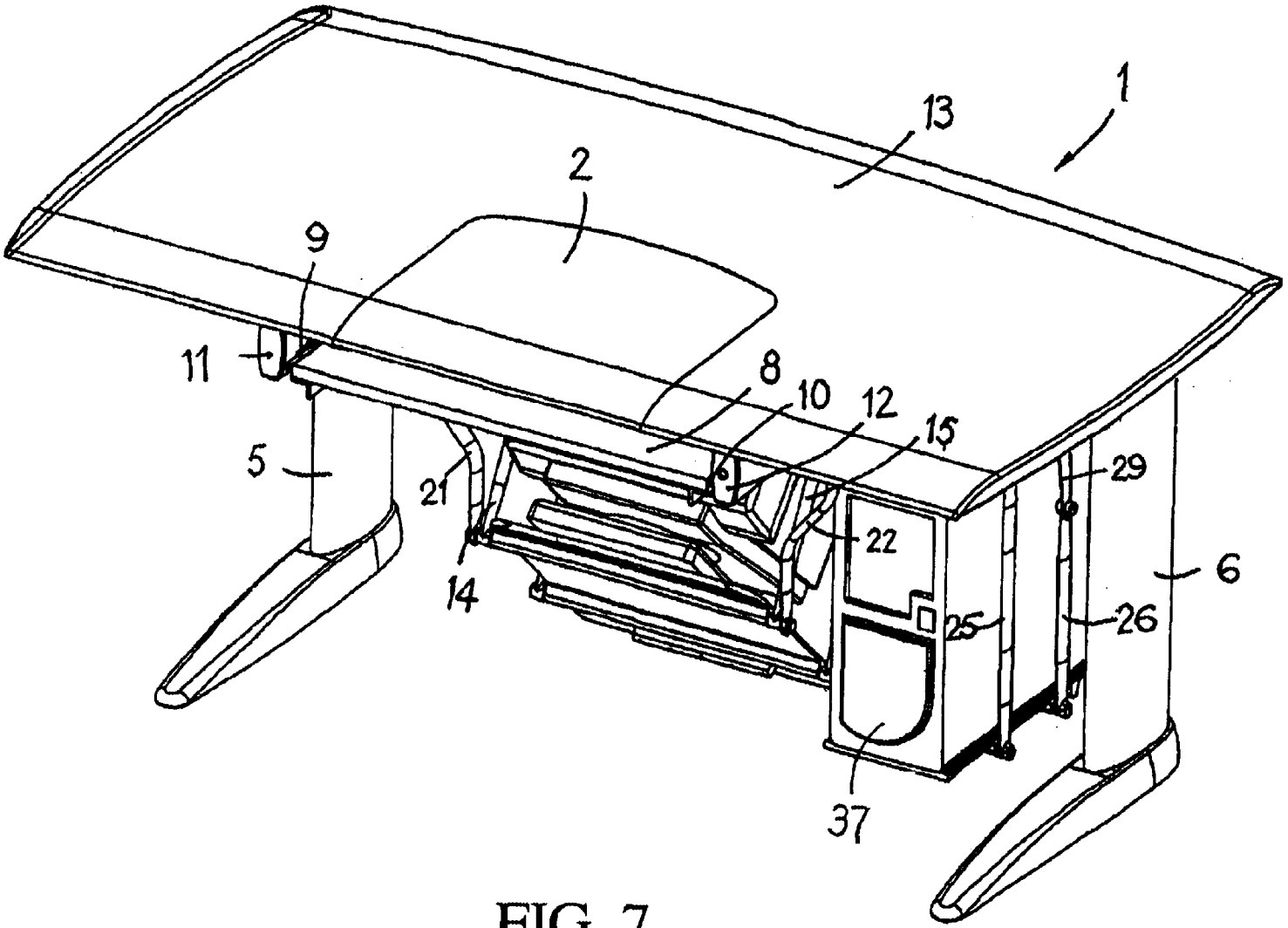
FIG. 7 is a oblique front view from above thereof.
Figure 8:
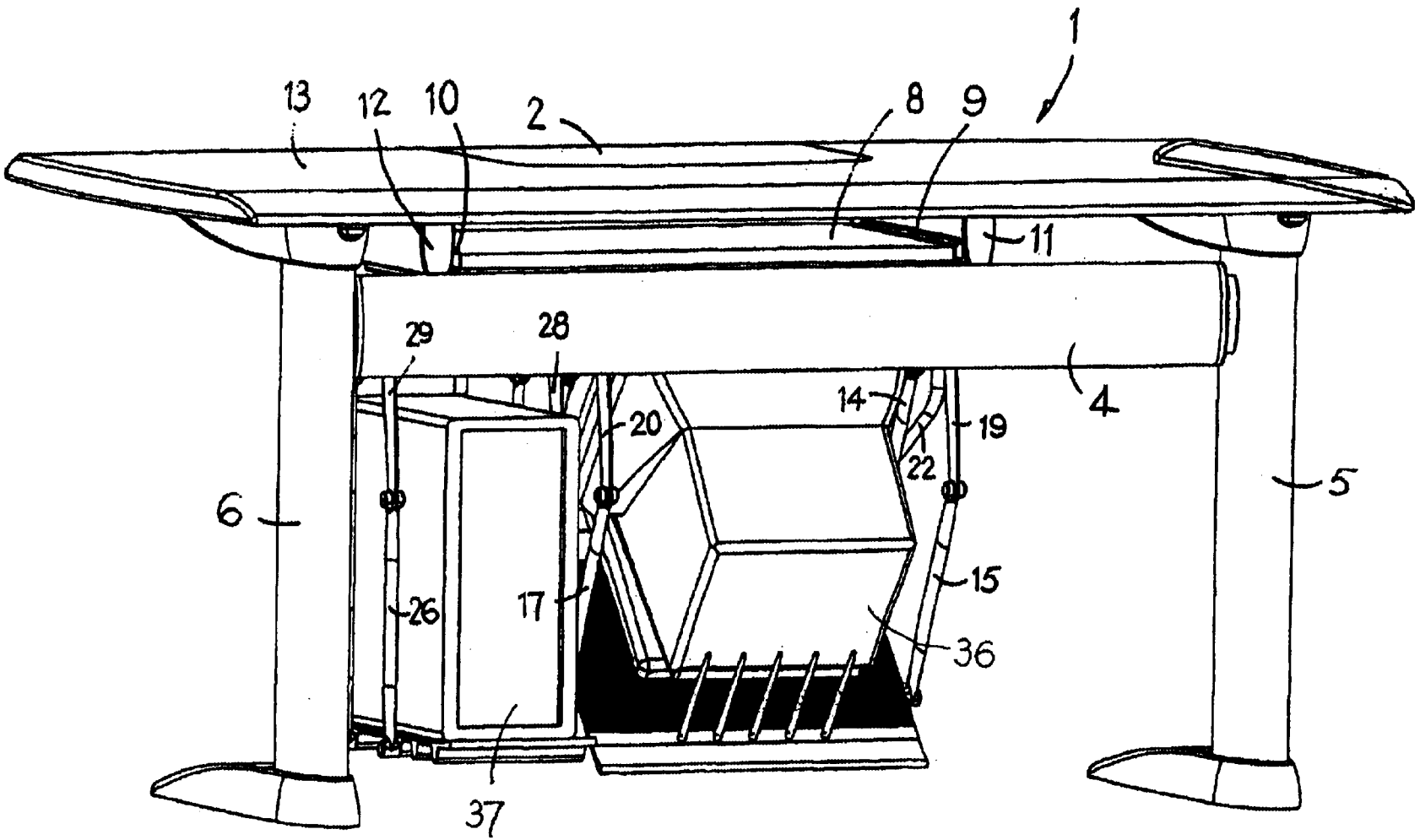
FIG. 8 is an oblique rear view.
Figure 9:
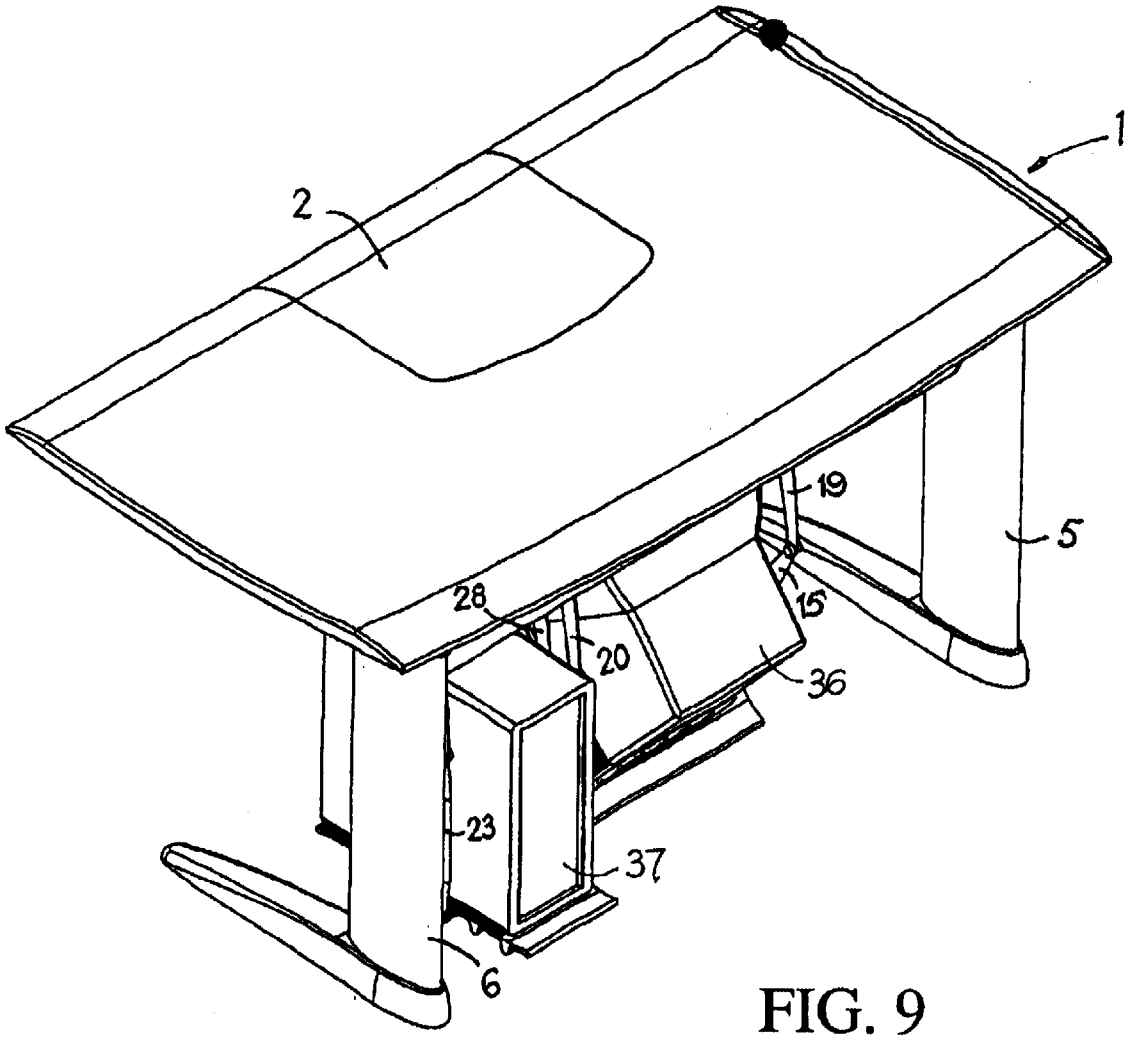
FIG. 9 is an oblique rear view from above thereof.

In all the drawings the same reference numerals are used for the same parts.

As shown in the drawings, a desk-like structure 1 has a transparent portion 2 for viewing a computer monitor. An adjustable suspended support means 3 is provided from a horizontal beam 4 which extends between legs 5 and 6 of the structure 1. The beam 4 has an insert 7 which is conveniently connectable and disconnectable from the beam and the suspended support means 3 extends from the insert 7 on the beam 4.

The desk-like structure 8 also supports a keyboard table 8 of the computer workstation, which keyboard table 8 is mounted on tracks 9 and 10 slidably so that it can be pulled out from an inoperative position to an operative position. The tracks 9, 10 are held on beams 11 and 12 to the underside of the desktop 13.

The adjustable suspended support means 3 also comprises four links 14, 15, 16 and 17, and a monitor table 18, which links 14, 15, 16, 17 are pivotally connected to the monitor table 18 and to two brackets 19 and 20 which in turn are rigidly fixed to the inserts which in turn are disconnectedly attached to the beam 4 which is fixed between the legs 5, 6.

Two links 21 and 22 are pivotally connected to the two tracks 9, 10 of the keyboard table 8 and to the monitor table 18 establishing a connection between the keyboard table 8 and the monitor table 18. When the keyboard table 8 is pulled out to an operative position the monitor is pulled forward by the links 14, 15, 16, 17 to an operative position.

Because the links 14, 15, 16, 17 are of set length and the tracks 9, 10 are of set length, the monitor always moves to the same set position every time it is used.

Links 23, 24, 25 and 26 suspend a CPU on a CPU table 27 in an adjustable position. The links 23, 24, 25 and 26 are pivotally connected to brackets 28 and 29 which, in turn, are rigidly fixed to the inserts which in turn are disconnectedly attached to the beam 4 which is fixed between the legs 5, 6.

Figure 10:
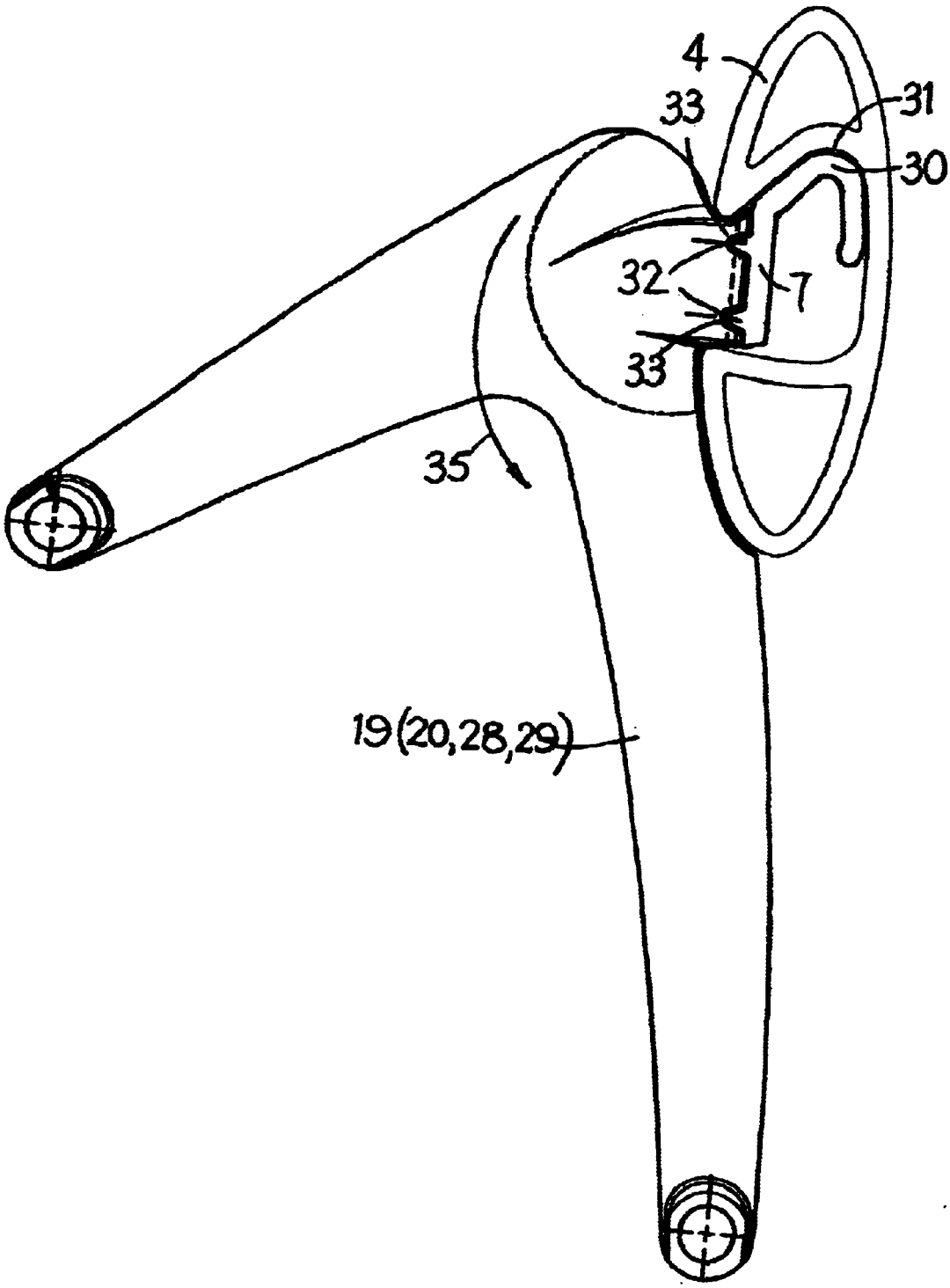
FIG. 10 is a transverse cross-sectional elevation view of a beam of a desk-like structure with a disconnectable insert connected into the beam and a bracket fixed to the insert.
Figure 11:
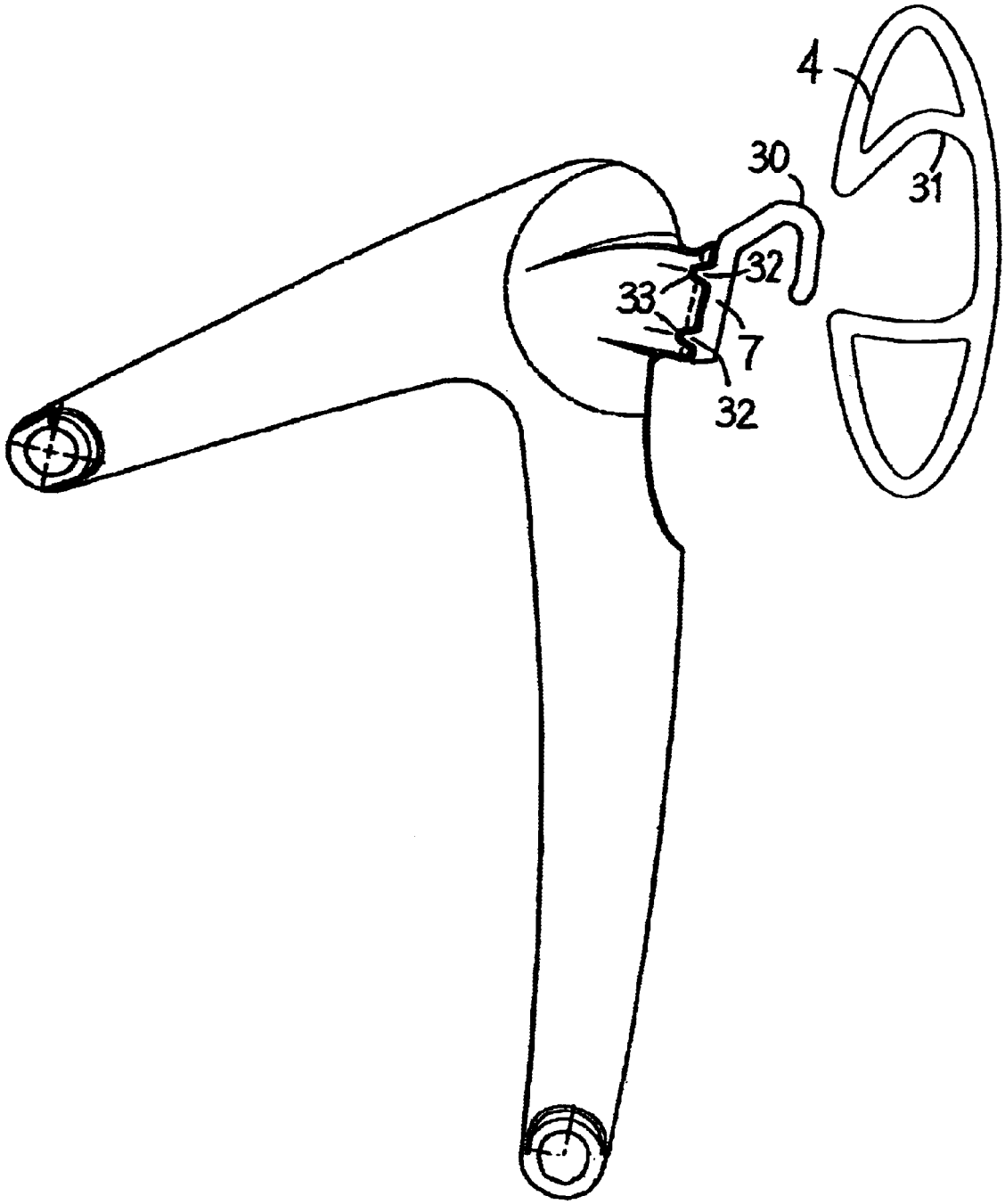
FIG. 11 is a transverse cross sectional elevation of the components of the suspended support means shown in the preceding FIG. 10, disconnected.

In FIGS. 10 and 11 the components shown apply both to the components described for supporting the monitor table 18 and components described for the CPU table 27. As shown more particularly in FIG. 10, the insert 7 is disconnectedly connected to the beam 4 by means of the formation 30 which nests in a hollow 31 of the beam. The brackets are fixed to the insert by means of nubs 32 engaging the hollows 33 and bolts (not shown) bolting them together. The torque indicated by arrow 35 resulting from the weight of the monitor and CPU normally keeps the insert 7 nested firmly the beam 4. If, however, the monitor and CPU are removed and the platforms are lifted, the insert 7 is easily disconnected from the beam 4 as can be seen by reference to FIG. 11 which shows them disconnected.

A gas strut or struts (not shown) can be used to provide a counterbalance for the weight of the monitor/keyboard and the CPU so that they conveniently remain in the position to which they are adjusted. Other known means can be used to perform this counterbalance function such as a telescopic strut or struts which can be locked in selected positions, weight or spring counterbalancing and the like.

In the drawings the monitor and CPU which make out no part of the embodiment of the invention are shown and identified by reference numerals 36 and 37 respectively.

What is claimed is:

1. Support means for a computer monitor and/or central processing unit and/or computer keyboard in furniture in which the monitor will be visible through a transparent panel in a working surface, in which the support means for the monitor includes adjustable suspension means and a beam, which suspension means can be attached to and detached from the beam, which beam can itself be attached to and detached from legs of the furniture, the beam extending transversely between the legs when attached to them.

2. Support means as claimed in claim 1, which further includes the provision of means for the connection of a computer keyboard table to the monitor support means, adapted so that when the keyboard table is pulled out from an inoperative position to an operative position the monitor is simultaneously moved from an inoperative position to an operative position.

3. Support means as claimed in claim 2, in which the keyboard table is mounted on tracks and can be slid on the tracks and the keyboard table has two links which connect it to the computer monitor support means.

4. Support means as claimed in claim 2, in which the adjustable suspension means is predisposed for the monitor to be constrained so that it is moved to the same selected operative position every time it is to be used.

5. Support means for a computer monitor and/or central processing unit and/or computer keyboard in furniture in which the monitor will be visible through a transparent panel in a working surface, in which the support means for the central processing unit includes adjustable suspension means and a beam, which suspension means can be attached to and detached from the beam, which beam can itself be attached to and detached from legs of a desks structure having a transparent portion for viewing a computer monitor, the beam extending transversely between the legs of the desk structure.

6. Support means as claimed in claim 5, wherein the support means for the monitor comprises the beam and adjustable suspension means.

7. Support means as claimed in claim 6, in which the adjustable suspension means for each of the monitor an central processing unit comprise two brackets which can be attached to and detached from the beam and four links which are adjustably connected to each of the brackets and support a platform for the monitor or central processing unit.

8. Support means as claimed in claim 7, in which the brackets are attached to the beam by means of inserts which fit in a groove extending along the beam, in which the inserts can be transversely slid in the groove and locked in selected positions.

9. Support means as claimed in claim 8, in which the inserts nest in a hollow of the beam and are locked in selected positions only by a torque exercised on them by the weight of the monitor causing the inserts to be nested firmly in the hollow.

* * * * *